US010697735B2

(12) United States Patent
Liu

(10) Patent No.: US 10,697,735 B2
(45) Date of Patent: Jun. 30, 2020

(54) FULL-COVERAGE BULLETPROOF BACKPACK

(71) Applicant: SDL TECHNOLOGY CO., LTD., Qinzhou, Guangxi (CN)

(72) Inventor: Tak Nam Liu, Guangxi (CN)

(73) Assignee: SDL TECHNOLOGY CO., LTD., Qinzhou (CN)

( * ) Notice: Subject to any disclaimer, the term of this patent is extended or adjusted under 35 U.S.C. 154(b) by 58 days.

(21) Appl. No.: 16/162,576

(22) Filed: Oct. 17, 2018

(65) Prior Publication Data

US 2020/0041231 A1 Feb. 6, 2020

(30) Foreign Application Priority Data

Aug. 3, 2018 (CN) ..... 2018 1 0877356

(51) Int. Cl.

| | |
|---|---|
| ***F41H 1/02*** | (2006.01) |
| ***A45F 3/04*** | (2006.01) |
| ***F41H 5/08*** | (2006.01) |
| *A45C 13/02* | (2006.01) |
| *A45F 3/06* | (2006.01) |

(52) U.S. Cl.

CPC ..... *F41H 1/02* (2013.01); *A45F 3/042* (2013.01); *F41H 5/08* (2013.01); *A45C 2013/026* (2013.01); *A45F 3/06* (2013.01)

(58) Field of Classification Search

CPC .... F41H 1/02; F41H 5/08; A45F 3/042; A45F 3/06; A45F 3/04; A45C 2013/026; A45C 13/02; A45C 13/30

See application file for complete search history.

(56) References Cited

U.S. PATENT DOCUMENTS

| | | | | |
|---|---|---|---|---|
| 2007/0259179 | A1* | 11/2007 | Ohnstad | F41H 1/02 428/397 |
| 2011/0097021 | A1* | 4/2011 | Curran | A45C 3/001 383/109 |
| 2014/0090140 | A1* | 4/2014 | Craig | A41D 1/06 2/2.5 |
| 2018/0042367 | A1* | 2/2018 | De Geus | A45F 3/04 |

* cited by examiner

*Primary Examiner* — Neil R McLean

(57) ABSTRACT

The present application provides a full-coverage bulletproof backpack, which comprises: a backpack body, a double-shoulder strap, a first sandwich, and a second sandwich, wherein the double-shoulder strap is fixedly provided on the back side of the backpack body, and the first sandwich and the second sandwich are provided in the backpack body, wherein the first sandwich is fixedly provided with a first bulletproof part, and the second sandwich is provided with a second bulletproof part, the second sandwich is provided with a pulling structure, the upper side of the double-shoulder strap is provided with an upper fixing part, and the lower side thereof is provided with a lower fixing part.

4 Claims, 4 Drawing Sheets

FULL-COVERAGE BULLETPROOF BACKPACK

CROSS REFERENCE TO RELATED APPLICATION

The present application claims priority to Chinese patent application No. 201810877356.1, entitled "Full-Coverage Bulletproof Backpack", filed on Aug. 3, 2018, the entire content of which is incorporated herein by reference.

TECHNICAL FIELD

The present application relates to the field of daily necessities and civil technology, and in particular to a full-coverage bulletproof backpack.

BACKGROUND

Guns are very dangerous weapons. China has strict control over guns. However, guns are not controlled in some countries, such as the United States. Therefore, there are frequent shooting incidents in the United States. If a shooting incident occurs, the masses have no daily necessities to withstand the shooting, which leads to the masses having no protective measures during the shooting.

The existing bulletproof backpack can only prevent bullets on the back, but cannot prevent bullets both on the front chest and on the back, so the existing bulletproof backpack is low in security.

SUMMARY

The embodiments of the present application provide a full-coverage bulletproof backpack, which may prevent bullets both on the back and on the front chest with the help of the backpack and has the advantage of improving the security of the user.

According to the first embodiment, the present application provides a full-coverage bulletproof backpack, comprising: a backpack body, a double-shoulder strap, a first sandwich, and a second sandwich.

The double-shoulder strap is fixedly provided on the back side of the backpack body, and the first sandwich and the second sandwich are provided in the backpack body, wherein the first sandwich is fixedly provided with a first bulletproof part, and the second sandwich is provided with a second bulletproof part. The second sandwich is provided with a pulling structure; the upper side of the double-shoulder strap is provided with an upper fixing part, and the lower side thereof is provided with a lower fixing part.

Preferably, the second bulletproof part comprises: a bulletproof plate composed of a plurality of layers of bulletproof fiber cloths, a pull-up strap and a pull-down strap, wherein the pull-up strap is provided with an upper buckle that is clamped and fixed onto the upper fixing part, and the pull-down strap is provided with a lower buckle that is clamped and fixed to the lower fixing part.

The embodiment of the present application is implemented with the following beneficial effects.

It can be seen that the full-coverage bulletproof backpack according to the embodiment of the present application is correspondingly provided with the following structures: the first bulletproof part is fixedly provided in the first sandwich. The backpack is provided to prevent bullets on the back and prevent bullets on the chest by the second bulletproof part in the second sandwich. That is, after the second sandwich is pulled open by the pulling structure, the built-in second bulletproof part is taken out and provided in front of the chest, and then it is fixed to the fixed part of the double-shoulder strap through the upper buckle and the lower buckle, so as to be full-coverage bulletproof on the front chest and on the back, thereby improving the bulletproof effect.

BRIEF DESCRIPTION OF THE DRAWINGS

In order to more clearly illustrate the technical solutions in the embodiments of the present application, the drawings to be used in the description of the embodiments will be briefly described below. It is obvious that the drawings in the following description are some embodiments of the present application. Those skilled in the art may also obtain other drawings based on these drawings without paying creative work.

DESCRIPTION OF THE EMBODIMENTS

The technical solutions of the embodiments of the present application will be described clearly and fully below in combination with drawings in the embodiments of the present application. It is apparent that the described embodiments are merely part of embodiments of the present application rather than all embodiments. Other embodiments achieved by those skilled in the art based on the embodiments in the present application without paying creative work will also fall into the scope of protection of the present application.

The term such as "first," "second," "third" and "fourth" in the description and claims of the present application and the drawings is used to distinguish different objects, rather than describe a specific order. Furthermore, the term such as "comprising", "having" or any variation thereof is intended to encompass non-exclusive inclusion. For example, a process, method, system, product, or device comprising a series of steps or units is not limited to the listed steps or units, but may further comprise steps or units not listed, or Preferably further comprises other steps or units inherent to such a process, method, product, or device.

References to "embodiment" herein mean that a particular feature, result, or characteristic described in connection with the embodiments may be comprised in at least one embodiment of the present application. This term existing at various positions in the specification does not necessarily refer to the same embodiment, and is not an independent or alternative embodiment that is mutually exclusive from other embodiments. Those skilled in the art will explicitly and implicitly understand that the embodiments described herein may be combined with other embodiments.

Figure 1A:
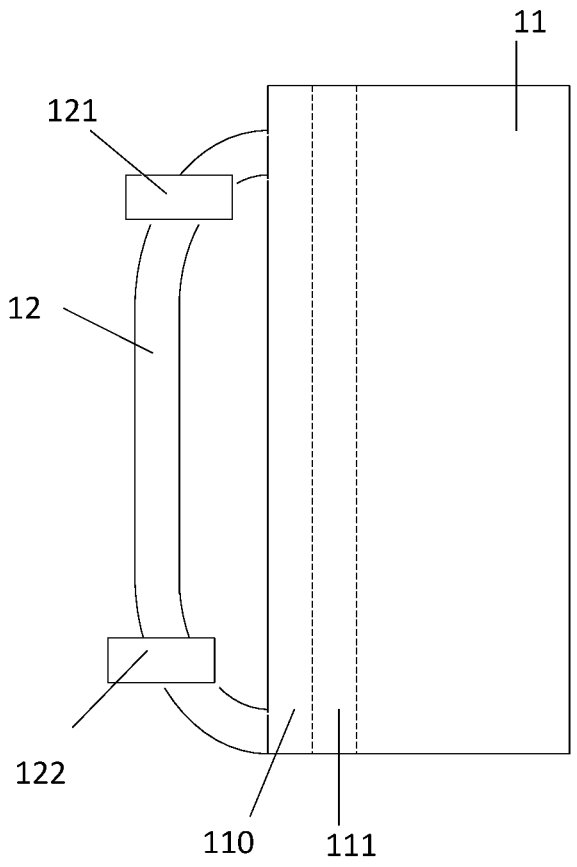
FIG. 1*a* is a schematic diagram illustrating the structure of a full-coverage bulletproof backpack according to the present application.

Referring to FIG. 1*a*, FIG. 1*a* is a schematic diagram illustrating the structure of a full-coverage bulletproof backpack. As shown in FIG. 1*a*, the bulletproof backpack comprises: a backpack body 11, a double-shoulder strap 12, a first sandwich 110 and a second sandwich 111.

The double-shoulder strap 12 is fixedly arranged on the back side of the backpack body 11, and the first sandwich 110 and the second sandwich 111 are provided inside the backpack body 11, wherein the first sandwich 110 is fixedly provided therein with a first bulletproof part, and the second sandwich 111 is provided therein with a second bulletproof part. The second sandwich 111 is provided with a pulling structure; the upper side of the double-shoulder strap 12 is provided with an upper fixing part 121, and the lower side thereof is provided with a lower fixing part 122.

Figure 1B:
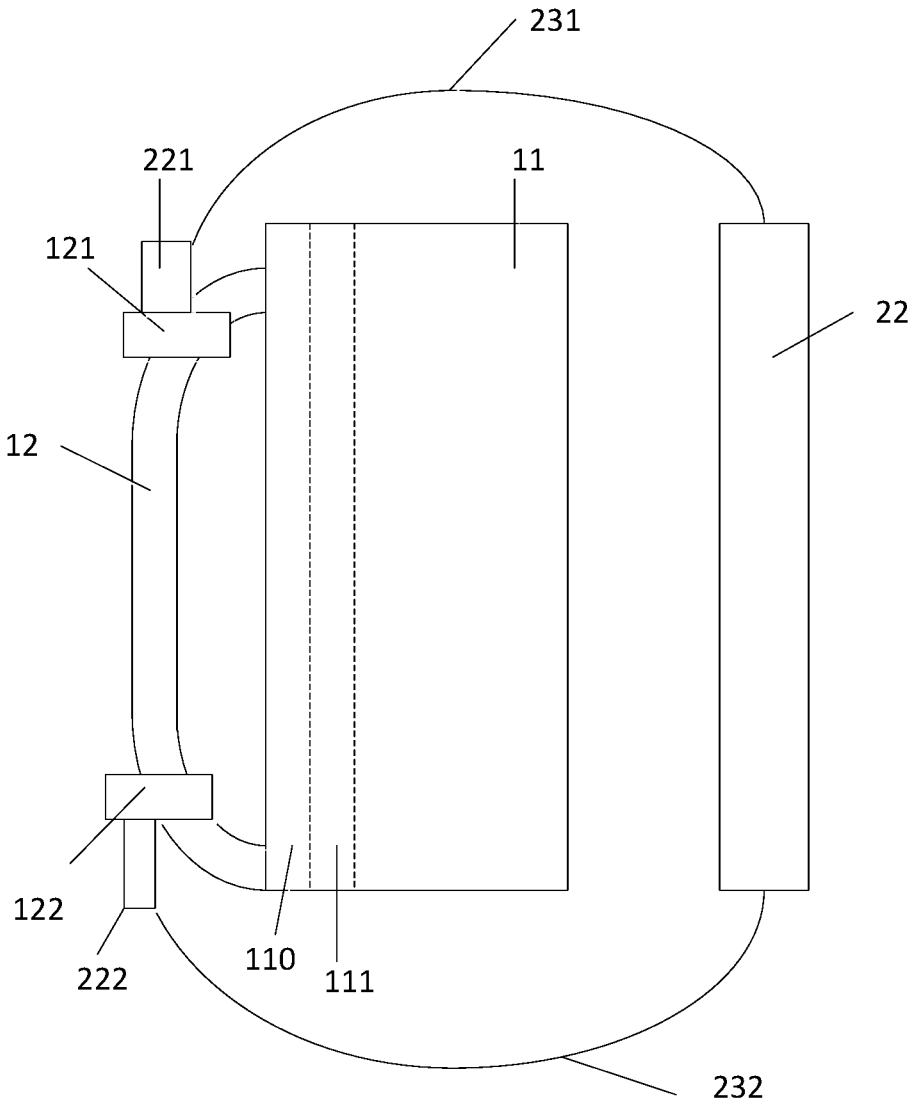
FIG. 1*b* is a schematic diagram illustrating the use of a full-coverage bulletproof backpack according to the present application.

Referring to FIG. 1*b*, the second bulletproof part comprises: a bulletproof plate 22 composed of a plurality of layers of bulletproof fiber cloths, a pull-up strap 231 and a pull-down strap 232, wherein the pull-up strap 231 is provided with an upper buckle 221 that is clamped and fixed to the upper fixing part 121, and the pull-down strap 232 is provided with a lower buckle 222 that is clamped and fixed to the lower fixing part 122.

The full-coverage bulletproof backpack is correspondingly provided in such a way that the first bulletproof part is fixedly provided in the first sandwich. The backpack is provided to prevent bullets on the back and prevent bullets on the chest by the second bulletproof part in the second sandwich. That is, after the second sandwich is pulled open via the pulling structure, the built-in second bulletproof part is taken out and provided in front of the chest, and then is fixed to the fixed part of the double-shoulder strap through the upper buckle and the lower buckle, so as to be full-coverage bulletproof on the front chest and on the back, thereby improving the bulletproof effect.

It should be noted that buckles are provided here to make it easier to fix the second bulletproof part. With regards to shooting, the impact of a bullet is very large. If it is provided by hand, the impact force will eject the second bulletproof part directly. Therefore, buckles are provided here for connection.

Preferably, the above pulling structure is specifically a zipper.

Preferably, each of the first bulletproof part and the second bulletproof part comprises a plurality of layers of bulletproof fiber cloths. The bulletproof fiber cloth includes, but is not limited to, a graphene fiber cloth or an aramid fiber fabric. Of course, in practical applications, the bulletproof fiber cloth provided by the present application may also be of other materials, and the present application does not limit the above bulletproof fiber cloth.

Figure 2:
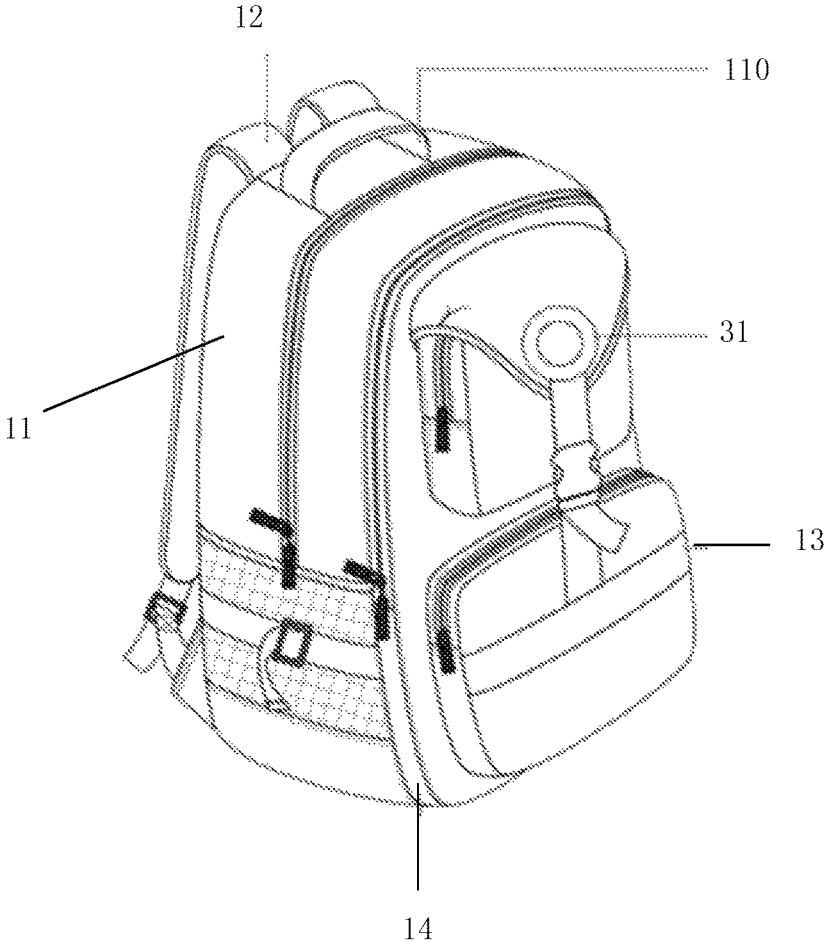
FIG. 2 is a schematic diagram illustrating the appearance of a bulletproof backpack according to the present application.

Preferably, the above bulletproof backpack may further comprise: a warning light 21, a horizontal warning strip 13 and a vertical warning strip 14 (as shown in FIG. 2).

Preferably, each layer of the plurality of layers of bulletproof fiber cloths consists of a plurality of diamond-shaped reinforcing units 30, wherein an included angle is formed between two neighboring diamond-shaped reinforcing units of the adjacent bulletproof fiber cloths.

Figure 3:
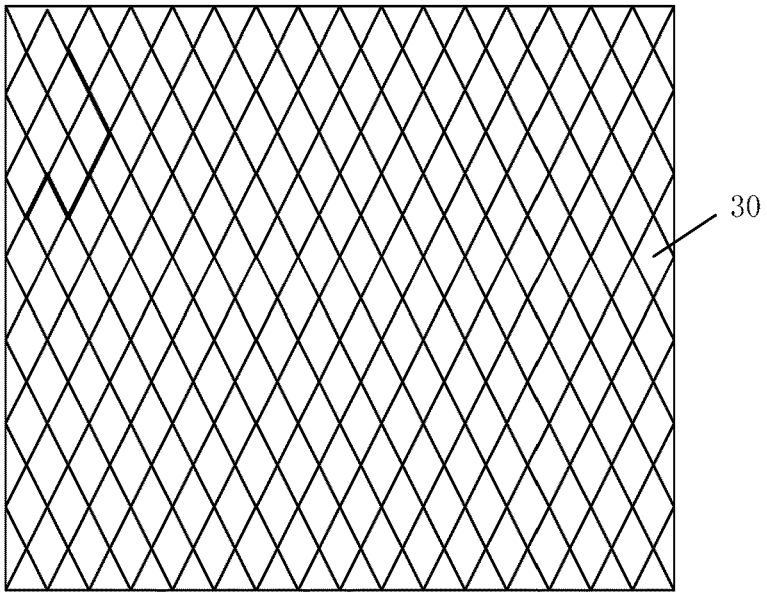
FIG. 3 is a schematic diagram illustrating the structure of a bulletproof fiber cloth according to the present application.

The plurality of diamond-shaped reinforcing units are provided so as to improve the bulletproof performance of the bulletproof fiber cloth. As shown in FIG. 3, the bulletproof fiber cloth may comprise a plurality of diamond-shaped reinforcing units. The diamond-shaped reinforcing units are provided to effectively relieve the impact of the bullet, especially to better relieve the rotary impact of the bullet, but the disadvantage is: for the edge position (i.e., four sides) of the diamond-shaped reinforcing unit 30, the structure is relatively weak, accordingly, in order to solve this problem, the inventor has shifted the plurality of layers of bulletproof fibers by an angle, therefore no matter what position the bullet hits, there are more diamond-shaped reinforcing units to weaken the impact of the bullet so that the entire bulletproof fiber cloth relieves the impact of the bullet and the bulletproof effect is improved.

Figure 4:
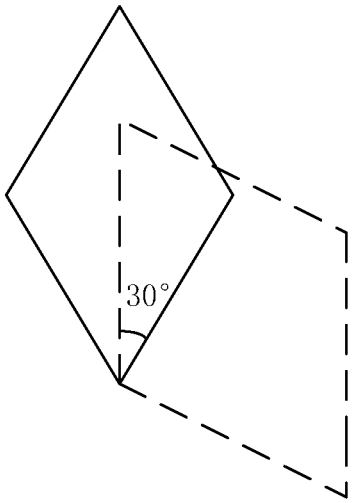
FIG. 4 is a schematic diagram illustrating the angle of a diamond-shaped reinforcing block of a 2-layer bulletproof fiber cloth according to the present application.

In particular, referring to FIG. 4, the above diamond-shaped reinforcing unit has an angle of a diamond shape of 60°, 120°, 60°, 120°, and an angle of 30° is formed between the diamond-shaped reinforcing units between the adjacent layers.

With this configuration, each diamond-shaped side line may be located in the center of the diamond-shaped reinforcing block of the adjacent layers. The center position can effectively improve the bulletproof ability of the diamond-shaped reinforcing block, which can achieve the level of a bulletproof for 9 mm gun. That is, the bulletproof level can be Level I, Level II A, or Level II, which is effectively bulletproof.

Figure 5:
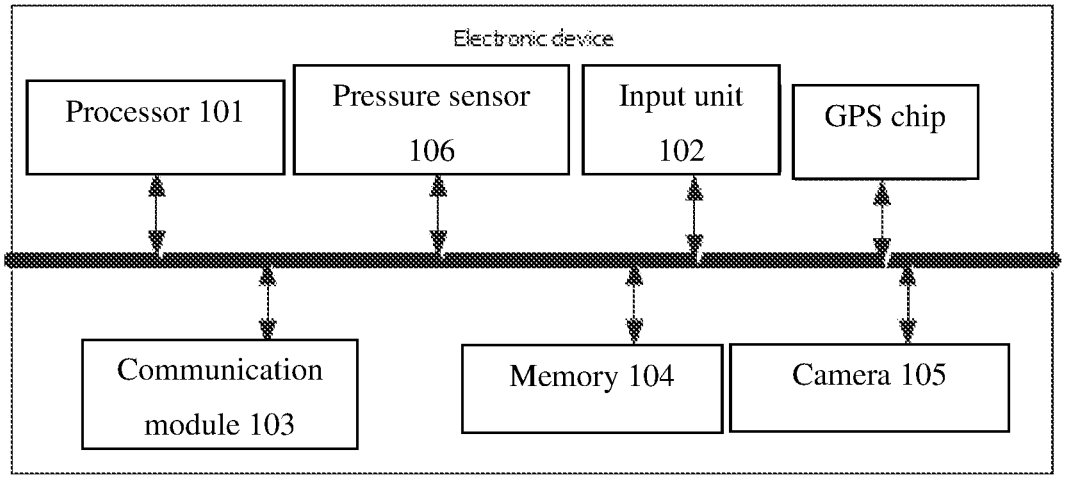
FIG. 5 is a diagram illustrating the structure of an electronic device included in a full-coverage bulletproof backpack according to the present application.

Preferably, as shown in FIG. 5, the full-coverage bulletproof backpack may further comprise an electronic device. As shown in FIG. 5, the electronic device may comprise: a processor 101, an input unit 102 (optional), a communication module 103, a memory 104, a camera 105, a pressure sensor 106, and other matching components, such as a battery, a speaker, a vibration motor, and the like. Refer to the configuration of a smart phone or a tablet for its specific structure, for example.

The pressure sensor 106 may be provided on the upper side of the double-shoulder strap 12, and the pressure sensor 106 is configured to detect the pressure value of the double-shoulder strap.

The processor 101 is configured to turn on the camera 105 to acquire an image when the pressure value is greater than the pressure threshold, and remind the user when the image is analyzed to determine that there is a shooting incident.

Reminding the user may include a prompt by audio or by other means, such as by vibration or other means.

The process of analyzing the image to determine that there is a shooting incident may specifically comprise:

a processor 101 configured to sample a first frame picture and a second frame picture with a set interval (for example, 20 frames or 30 frames), extract a first group of N positions corresponding to the images of N people of the first frame picture, extract a second group of N positions corresponding to the images of the same N people of the second frame picture, acquire N distances between the second group of N positions and the first group of N positions, extract M distances greater than a set threshold from N distances, and determine that there is a shooting incident if M is greater than the set number, wherein N is an integer greater than or equal to 2, and $M \leq N$.

The principle of this technical solution is that the video and the file reacted to the shooting incident are analyzed with certain characteristics that a large number of people are in a disorderly moving state within a certain time within the video, and the number of the people is still relatively large. In this way, the applicant samples the first frame picture and the second frame picture of the set interval, and compares the two pictures to determine whether a large number of people are in a moving state. First, since the running speed of people is limited due to the relatively short time within the set interval, there will not be greatly difference between the positions of people of the two frame pictures. In this way, it is possible to analyze whether people are in a running state. In addition, since the backgrounds in which the two frame pictures are taken are similar, that is, the reference objects are the same, the number of pixel points between the reference objects and the N people can substantially determine the position corresponding to the N people, specifically comprising the fact that if the difference of pixel points between the corresponding people of the N people of the two frame pictures and the same reference object is greater than the set difference, it is determined that the distance of the people between the two frames is greater than the set threshold. Of course, in practical applications, the difference between the distances of the people of the two frame pictures can also be determined by other means. Therefore, the present application can automatically judge the situation of the back, thereby realizing a reminder to the shooting incident on the back of the user and improving security.

The camera 105 may be provided on the front side of the full-coverage bulletproof backpack.

Preferably, the full-coverage bulletproof backpack may further comprise a GPS chip, which may be integrated in the processor and is configured to locate a position to acquire GPS coordinates;

The processor 101 is further configured to determine the shooting incident, determine the current position according to the GPS coordinates, acquire the secure position around the current position, generate a path between the secure position and the current position, and provide the path to the user by voice prompting.

This technical solution realizes positioning in combination with GPS coordinates. After the shooting incident is determined, the current position is positioned according to the GPS coordinates, the secure position is acquired, and the path is generated, thereby avoiding the danger caused by the user running around and improving the security of the user.

In the above embodiments, the various embodiments are described in different focuses, and the parts that are not detailed in a certain embodiment may refer to the related descriptions of other embodiments.

In the several embodiments provided by the present application, it should be understood that the disclosed device may be implemented in other ways. For example, the device embodiments described above are merely illustrative. For example, the division of the unit is only a logical function division. In actual implementation, there may be another division manner. For example, a plurality of units or components may be combined or integrated into another system, or some features may be ignored or not implemented. In addition, the illustrated or discussed mutual coupling or direct coupling or communication connection may be indirect coupling or communication connection through some interfaces, devices or units, and may be electrical or in other forms.

In addition, all the functional units in each embodiment of the present application may be integrated in one processing unit, or each unit may exist alone physically, or two or more units may be integrated in one unit. The above integrated unit may be implemented in the form of hardware or in the form of software program modules.

The embodiments of the present application have been described in detail above. Specific examples are used herein to set forth the principles and the embodiments of the present application, and the descriptions of the above embodiments are only meant to help understanding of the method and the core idea of the present application. Meanwhile, those skilled in the art may make alterations to the specific embodiments and the scope of application in accordance with the idea of the present application. In conclusion, the contents of the present specification shall not be interpreted as limiting to the present application.

What is claimed is:

1. A full-coverage bulletproof backpack comprising: a backpack body, a double-shoulder strap, a first sandwich, and a second sandwich, wherein the double-shoulder strap is fixedly provided on the back side of the backpack body, and the first sandwich and the second sandwich are provided in the backpack body, wherein the first sandwich is fixedly provided with a first bulletproof part therein, and the second sandwich is provided with a second bulletproof part therein, the second sandwich is provided with a pulling structure, the upper side of the double-shoulder strap is provided with an upper fixing part, and the lower side thereof is provided with a lower fixing part, and the second bulletproof part comprises a bulletproof plate composed of a plurality of layers of bulletproof fiber cloths, a pull-up strap and a pull-down strap, wherein the pull-up strap is provided with an upper buckle that is clamped and fixed onto the upper fixing part, and the pull-down strap is provided with a lower buckle that is clamped and fixed to the lower fixing part, each layer of the plurality of layers of bulletproof fiber cloths consists of a plurality of diamond-shaped reinforcing units, and an included angle is formed between two neighboring diamond-shaped reinforcing units of the adjacent bulletproof fiber cloths, the diamond-shaped reinforcing unit has an angle of a diamond shape of 60°, 120°, 60°, and 120°, and an included angle of 30° is formed between the diamond-shaped reinforcing units of the adjacent bulletproof fiber cloths.

2. A full-coverage bulletproof backpack comprising: a backpack body, a double-shoulder strap, a first sandwich, and a second sandwich, wherein the double-shoulder strap is fixedly provided on the back side of the backpack body, and the first sandwich and the second sandwich are provided in the backpack body, wherein the first sandwich is fixedly provided with a first bulletproof part therein, and the second sandwich is provided with a second bulletproof part therein, the second sandwich is provided with a pulling structure, the upper side of the double-shoulder strap is provided with an upper fixing part, and the lower side thereof is provided with a lower fixing part, and the second bulletproof part comprises a bulletproof plate composed of a plurality of layers of bulletproof fiber cloths, a pull-up strap and a pull-down strap, wherein the pull-up strap is provided with an upper buckle that is clamped and fixed onto the upper fixing part, and the pull-down strap is provided with a lower buckle that is clamped and fixed to the lower fixing part, the full-coverage bulletproof backpack further comprises a processor, a communication module, a memory, a camera and a pressure sensor, wherein the communication module, the memory, and the camera are respectively connected with the processor, the pressure sensor is provided on the upper side of the double-shoulder strap and configured to detect the pressure value of the double-shoulder strap, the camera is provided on the front side of the full-coverage bulletproof backpack and configured to acquire an image, the processor is configured to turn on the camera when the pressure value is greater than the pressure threshold, and remind the user when the image is analyzed to determine that there is a shooting incident.

3. The bulletproof backpack of claim 2, wherein the processor is configured to sample a first frame picture and a second frame picture with a set interval, extract a first group of N positions corresponding to the images of N people of the first frame picture, extract a second group of N positions corresponding to the images of the same N people of the second frame picture, acquire N distances between the second group of N positions and the first group of N positions, extract M distances greater than a set threshold from N distances, and determine that there is a shooting incident if M is greater than the set number, wherein N is an integer greater than or equal to 2, and $M \leq N$.

4. The bulletproof backpack of claim 2, wherein the full-coverage bulletproof backpack further comprises a GPS chip, which is configured to locate a position to acquire GPS coordinates, and the processor is further configured to determine the shooting incident, determine the current position according to the GPS coordinates, acquire the secure position around the current position, generate a path between the secure position and the current position, and provide the path to the user by voice prompting.

* * * * *